United States Patent [19]

Butterworth et al.

[11] Patent Number: 4,488,855

[45] Date of Patent: Dec. 18, 1984

[54] MAIN BEARING LUBRICATION SYSTEM FOR SCROLL MACHINE

[75] Inventors: Arthur L. Butterworth, La Crosse, Wis.; James C. Tischer, La Crescent, Minn.; Robert E. Utter, Genoa, Wis.

[73] Assignee: The Trane Company, La Crosse, Wis.

[21] Appl. No.: 453,304

[22] Filed: Dec. 27, 1982

[51] Int. Cl.[3] ..... F04B 39/02; F01C 1/02; F01C 21/04

[52] U.S. Cl. ..... 417/368; 417/372; 417/902; 418/55; 418/88; 418/94; 418/101

[58] Field of Search ..... 417/368, 371, 372, 410, 417/902; 418/94, 55, 88, 101

[56] References Cited

U.S. PATENT DOCUMENTS

| | | | |
|---|---|---|---|
| 2,556,435 | 6/1951 | Moehral et al. | 417/368 |
| 3,334,808 | 8/1967 | Parker et al. | 230/206 |
| 3,387,774 | 6/1968 | Gannaway et al. | 417/902 |
| 3,618,337 | 11/1971 | Mount | 417/366 |
| 3,850,550 | 11/1974 | Kaessen | 417/372 |
| 4,065,279 | 12/1977 | McCullough | 62/510 |
| 4,181,474 | 1/1980 | Shaw | 417/366 |
| 4,343,599 | 8/1982 | Kousokabe | 417/902 |
| 4,389,171 | 6/1983 | Eber et al. | 418/55 |
| 4,403,927 | 9/1983 | Butterworth et al. | 418/55 |

FOREIGN PATENT DOCUMENTS

| | | |
|---|---|---|
| 1386836 | 3/1975 | United Kingdom . |
| 2115876 | 9/1983 | United Kingdom . |

*Primary Examiner*—Richard E. Gluck
*Assistant Examiner*—Peter M. Cuomo
*Attorney, Agent, or Firm*—Ronald M. Anderson; Carl M. Lewis

[57] ABSTRACT

A system for lubricating the main drive shaft bearings in a scroll compressor enclosed within a hermetic shell. The drive shaft and its main bearings are supported in a frame that defines first and second chambers adjacent each end of a main bearing. Each of the chambers includes an opening to a spatial volume contained within the compressor shell. An oil pump at the lower end of the drive shaft supplies oil through a bore in the shaft to a swing link bearing and a thrust bearing, both disposed adjacent its upper end. Oil is dispersed into the spatial volume as a mist of oil droplets by the rotating elements connected to the drive shaft. Fan means are disposed within the second chamber and are operative to develop a differential pressure between the two chambers so that oil droplets are drawn toward the first chamber, lubricating the main bearing as they pass through it.

13 Claims, 6 Drawing Figures

MAIN BEARING LUBRICATION SYSTEM FOR SCROLL MACHINE

DESCRIPTION

TECHNICAL FIELD

This invention generally pertains to a lubricant distribution system for a scroll machine, and specifically to a system for distributing oil to the main drive shaft bearings of such a machine.

BACKGROUND ART

The generic term "scroll machine" encompasses a class of positive fluid displacement apparatus which use orbiting involute spiral wraps formed on facing parallel plates to compress, expand, or pump a fluid. Although many designs for scroll machines exist in the prior art, very few have been successfully reduced to practice as commercially viable products. Some to the problems which have arisen in these development attempts are unique to the scroll machine, e.g., providing effective seals between the involute wraps and the end plates. However, other problems common to rotating machinery must also be solved. For example, as in any mechanical device having moving parts subject to friction and loading, it is necessary to provide proper lubrication to avoid excessive wear. In a scroll machine, an adequate lubricant supply is particularly important for the bearings asssociated with the rotating drive shaft and with the elements for converting the rotational motion of the shaft into the orbital motion of the scroll plates.

The lubrication system used in scroll machines and other rotating machinery having vertical drive shafts generally follow a similar pattern. Typically in such machines, oil flows from a reservoir located in the lower part of the machine housing through oil passages drilled or formed in the drive shaft, for distribution to the various components requiring lubrication. An example of such a design is disclosed in U.S. Pat. No. 4,065,279. As shown therein, a centrifugal oil pump forces oil from a reservoir up through two eccentrically placed oil passages bored in a vertical drive shaft. One of these passages supplies oil to a series of grooves associated with a swing link journal bearing, thereby lubricating it and an adjacent thrust bearing. Oil flowing in the second internal passage of the drive shaft is distributed through a right-angle passage for lubrication of the top journal bearing of the drive shaft. This design illustrates one solution to a problem shared by most designs for scroll machines—providing adequate lubrication to the thrust, swing link, and drivel shaft bearings—difficult due to the spatial separation of these bearings and the relatively dissimilar motion with which they are associated.

The lubrication requirements of the various types of bearings used in a scroll machine are substantially different. For example, roller bearings require very little lubrication, and in fact, experience frictional losses if supplied excessive oil. By comparison, a thrust bearing comprising a sliding surface requires substantially more oil flow. A lubrication system for a machine in which various types of bearings are used should thus allocate oil flow between the bearings according to their lubrication requirements.

In a scroll machine, part of the oil flowing through the delivery system to the orbiting scroll thrust bearing may be diverted to flow downward through the main drive shaft bearing. However, if conical or tapered drive shaft main bearings are used, oil will not flow through the bearing unless it is introduced at the end of the bearing where the rollers are radially closer to the drive shaft. Centrifugal force prevents oil flow through the conical bearing in the opposite direction. Thus, if cone bearings must be oriented to provide axial support of the drive shaft so that lubrication by gravity flow is not possible, another means must be found to introduce the lubricant into the bearing at the proper end.

One method of lubricating the main bearings as shown in the '279 patent, is to drill radial oil passages into the drive shaft intersecting the bore through which oil is delivered to bearings at the top of the shaft. There are several drawbacks to this approach, the most significant being that it diverts part of the oil flow away from the bearings adjacent the upper end of the shaft, e.g., the scroll plate thrust bearing. Also, the small diameter radial oil passage which intersects the bore may become clogged with contaminants, causing eventual damage due to lack of lubricant supply to the main drive shaft bearings.

In view of the foregoing, it is therefore an object of this invention to provide a lubrication system for lubricating the main drive shaft bearing of a scroll machine without diverting oil flow away from the other critical bearings in the machine.

It is a further object of this invention to provide a main drive shaft lubrication system that is both efficient and unlikely to fail due to plugging with contaminants.

A still further object of this invention is to supply lubricant to the proper end of a conical main bearing so that oil flow through the bearing is encouraged.

Yet a still further object is to recirculate oil through the main bearing prior to the return of the oil to a reservoir.

DISCLOSURE OF THE INVENTION

The subject invention is an oil distribution system for lubricating a main drive shaft bearing of a scroll apparatus. An oil pump connected to the drive shaft has an inlet submerged in an oil reservoir and an outlet in fluid communication with an enclosed spatial volume disposed adjacent one end of the drive shaft bearing. Oil circulated by the pump is dispersed into the spatial volume as a mist of oil droplets.

A frame supports the drive shaft main bearing and defines a chamber at one end of the shaft, opposite the spatial volume. This chamber is in fluid communication with the spatial volume by means of an opening formed in the frame. Fan means, rotatably driven by the drive shaft, are disposed within the chamber and are operative to draw fluid carrying oil entrained therein as a mist, into the chamber, and through the drive shaft main bearing to lubricate it.

DESCRIPTION OF THE PREFERRED EMBODIMENT

Figure 1:
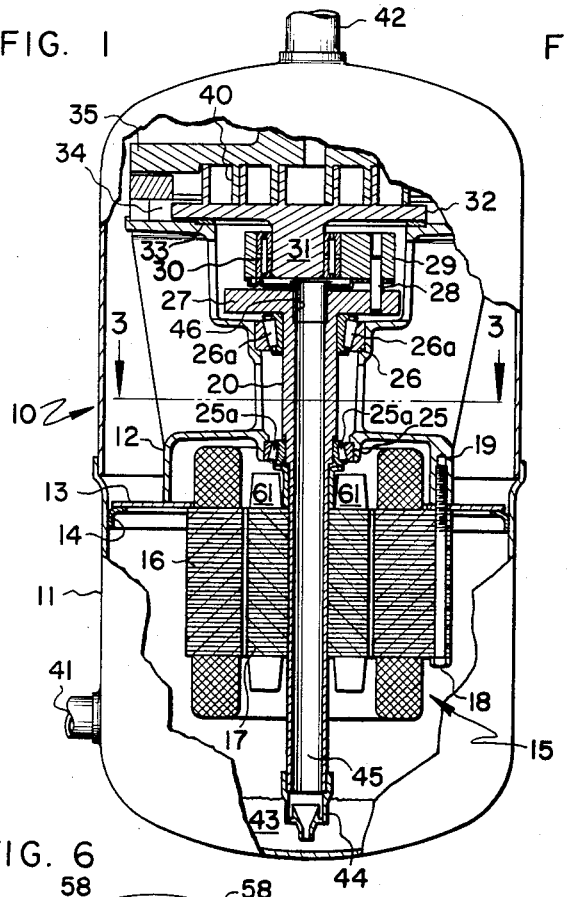
FIG. 1 is a cutaway view of a scroll machine showing a sectional view of the drive shaft and its supporting frame.

With reference to FIG. 1, a scroll machine is generally denoted by reference numeral 10. In this preferred embodiment, the scroll machine 10 is a refrigerant fluid compressor; however, it will be understood as noted above, that a scroll machine incorporating this subject invention might also be configured for use as a pump or for expanding a gaseous fluid. Scroll compressor 10 includes a hermetic shell 11 that encloses substantially all the operating mechanism of the device. A frame 12, formed from cast aluminum in the preferred embodiment, supports the operating mechanism in cooperation with annular ring 13. Ring 13 extends radially about the axis of compressor 10, and rests on flange 14 welded to the inside of the lower portion of hermetic shell 11.

An electric motor 15 depends from the supporting structure provided by annular ring 13 and frame 12, and comprises stator 16 and a rotor 17. Stator 16 is attached to the annular ring 13 and frame 12 by means of a plurality of spaced-apart bolts 18 that are threaded into blind holes 19 formed in the lower portion of frame 12. Rotor 17 is press-fit on a drive shaft 20 that extends along the longitudinal axis of compressor 10. The drive shaft 20 and rotor 17 are in turn supported and centered within frame 12 and stator 16 by a lower drive shaft main bearing 25 and an upper drive shaft main bearing 26. Both drive shaft main bearings 25 and 26 are of the cone type, and include roller cone bearings 25*a* and 26*a*, respectively.

On the upper end of drive shaft 20 is formed a flat plate comprising a drive shaft crank 27. A drive crank pin 28, formed on the crank 27, is radially displaced from and parallel to the longitudinal axis of drive shaft 20, and connects the drive shaft crank 27 to a swing link 29. Swing link 29 undergoes minimal rotation relative to drive crank pin 28 and is journaled so that it freely pivots about crank pin 28 with only a few degrees of rotation. One of the functions of swing link 29 is to convert the rotational motion of drive shaft 20 and crank 27 into an orbital motion. Swing link 29 includes a drive stud roller bearing 30 in which is seated a drive stud 31 formed on the lower surface of an orbiting scroll plate 32. Rotation of drive shaft 20 and crank 27 thus causes swing link 29 to draw the scroll plate 32 around in an orbital path having a radius equal to the displacement of the center of drive stud 31 from the longitudinal axis of drive shaft 20. The principles by which scroll machines such as compressor 10 operate are well known to those skilled in the art and have been explained in numerous prior art U.S. patents, as for example, U.S. Pat. No. 4,065,279.

In the preferred embodiment of compressor 10, axial force is applied to the lower surface of the orbiting scroll plate 32 by means of a thrust bearing 33 comprising an annular ring having a radial grooving pattern on its upper face to insure proper lubricant distribution across that surface. Thrust bearing 33 is fitted into the upper lip of frame 12 and supported thereby.

Orbiting scroll plate 32 is constrained to orbit in a fixed angular relationship relative to a stationary scroll plate 32 by means of an Oldham coupling 34, as is well known in the art. Both the orbiting and stationary scroll plates 32 and 35, respectively, include involute wrap elements 40 on their facing surfaces, that by means of moving line contacts define moving pockets of fluid as scroll plate 32 orbits relative to the stationary scroll plate 35. The relative orbital motion of the scroll plates 32 and 35 causes these pockets of fluid to experience a change in pressure and volume as the fluid moves radially inward toward the center of the plates. Thus, fluid entering compressor 10 through an inlet port 41 in hermetic shell 11, passes between rotor 17 and stator 16 providing a cooling effect, is compressed by the orbital motion of scroll plate 32, and discharges from the hermetic shell 11 through outlet port 42 that is in fluid communication with the center of stationary scroll plate 35.

The lower portion of hermetic shell 11 includes an oil reservoir 43. On the lower end of drive shaft 20 is attached an oil pump 44 having a conical shape, which by means of centrifugal force developed as drive shaft 20 rotates, is operative to force oil upwards within a bore 45 disposed along the longitudinal axis of shaft 20. Lubricating oil rises upward along the inner surface of bore 45 and spills out over the top of an oil standpipe 46 fitted into drive crank 27.

Figure 2:
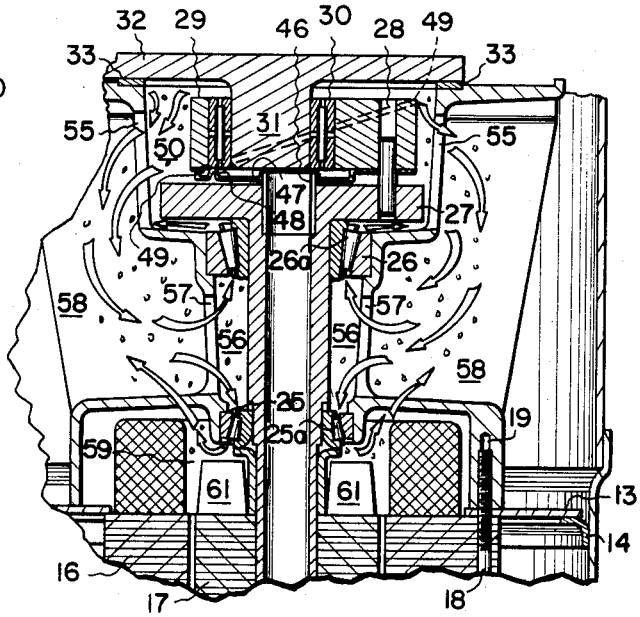
FIG. 2 is an exploded cross-sectional view of the drive shaft and main bearings in place within the frame, showing the paths by which oil circulates through the main bearings.

FIG. 2 shows in greater detail the mechanism for distributing oil exiting standpipe 46. Oil collector cup 47 is attached to the lower surface of swing link 29 and is of a dimension such that it clears the upper surface of drive crank 27 while rotating with swing link 29. Collector cup 47 is circular in shape, having an opening disposed around standpipe 46 in a position that is eccentric relative to the center of cup 47. Oil exiting standpipe 46 is thrown by centrifugal force away from the longitudinal axis of drive shaft 20. Accordingly, an arcuate baffle 48 is disposed in the lobular or offset portion of collector cup 47 immediately below the bearing 30, so that it intercepts a portion of the oil flowing from standpipe 46. Oil striking baffle 48 is thereby deflected upward and into the open end of the rolling element swing link bearing 30. Oil not intercepted by baffle 48 flows behind it, accumulating in a pool in the portion of oil collector cup 47 which is radially farthest from the longitudinal axis of drive shaft 20. Oil in this collected pool flows upward at an angle through an oil passage 49 formed in the swing link 29 and exits immediately adjacent thrust bearing 33, to lubricate it. In addition, oil flowing through rolling element bearing 30 exits at the upper surface of swing link 29 and is thrown radially outward by centrifugal force as the swing link 29 rotates. The rotational motion of swing link 29 and of drive shaft crank 27 is sufficiently vigorous to cause oil dripping from the lower surface of orbiting plate 32 and oil that has passed through bearing 30 to disperse as a mist of droplets.

Figure 4:
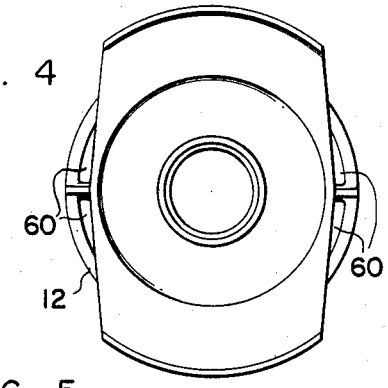
FIG. 4 is an end view of the supporting frame casting used in the scroll machine.
Figure 5:
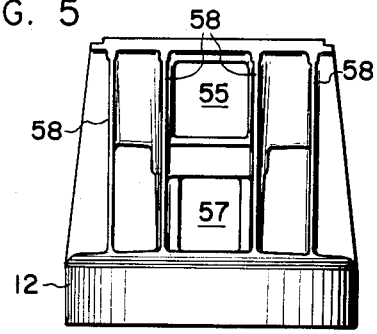
FIG. 5 is a side view of the supporting frame casting.
Figure 6:
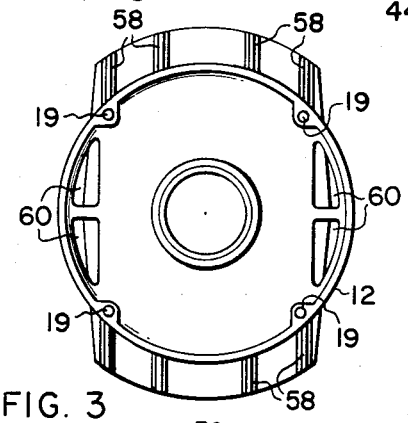
FIG. 6 is a view of the opposite end of the supporting frame casting from that shown in FIG. 4.
Figure 3:
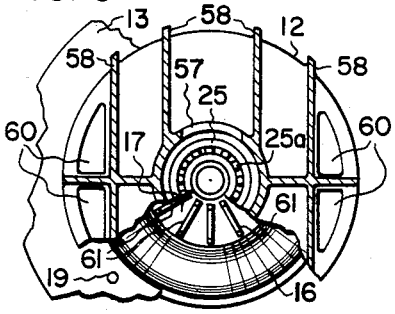
FIG. 3 is a cross-sectional view taken along section line 3—3 of FIG. 1.

FIGS. 4, 5, and 6 illustrate the conformation of frame 12 that facilitates the distribution of oil droplets. Crank 27 and swing link 29 rotate within a chamber 50 defined by the upper portion of frame 12. The rotational motion of swing link 29 and drive shaft crank 27 throws oil droplets through openings 55 disposed in frame 12 adjacent the swing link chamber 50.

As previously noted, conical roller bearings tend to resist lubricant flowthrough when oil is supplied to the ends of the roller elements that are oriented radially further from the longitudinal axis of rotation of the shaft on which the bearing is mounted than are the other ends of the roller elements. Thus, it is necessary to supply oil to conical roller bearings 26 from the end adjacent a chamber 56 defined between the circumferential surface of drive shaft 20 and inner surface of frame 12. Lubrication in the form of the oil droplets dispersed within the refrigerant fluid in the space between hermetic shell 11 and frame 12 reaches the lower end of conical bearings 26 through openings 57 formed in frame 12, and by passing through chamber 56. Refrigerant fluid carrying entrained oil droplets circulates through upper drive shaft bearing 26 as a result of the pressure differential across bearing 26 caused by the rotation of swing link 29. The rotational motion of swing link 29 within swing link chamber 50 creates a centrifugal fan effect, and forces refrigerant fluid through openings 55, thus reducing the pressure within chamber 56. The lower pressure in chamber 50 draws the refrigerant fluid and oil droplets from chamber 56 through bearings 26. Part of the oil circulating through drive shaft main bearings 26 is again thrown from swing link chamber 50 through openings 55 for recirculation through the main bearings 25 and 26. Frame 12 includes structural webbing 58 that is used both to reinforce frame 12 and to define a volume of space through which the oil droplets entrained in refrigerant vapor may circulate.

The lower portion of frame 12 defines a rotor chamber 59 around the upper end of rotor 17 and adjacent main drive shaft bearing 25. A plurality of openings 60 are provided in the lower skirt of frame 12, giving access to rotor chamber 59 from the adjoining volume enclosed by hermetic shell 11. Conical rollers 25*a* are supplied oil through a mechanism similar to that used to supply lubrication to conical rollers 26*a*. The upper end of rotor 17 includes a plurality of radially aligned tabs 61 which rotate with rotor 17 about the longitudinal axis of drive shaft 20 when electric motor 15 is energized. Tabs 61 likewise act as a centrifugal fan to create a differential pressure across main drive shaft bearing 25 that is effective to draw refrigerant fluid with oil droplets entrained therein through the bearing to lubricate it. Refrigerant fluid is forced through openings 60 from rotor chamber 59 by the motion of tabs 61, causing a slightly lower pressure within rotor chamber 59 than exists in chamber 56. This pressure differential draws oil droplets (entrained in refrigerant fluid) through main drive shaft bearing 25 in the preferred direction, insuring that it receives adequate lubrication.

It should be apparent that both main drive shaft bearings 25 and 26 are oriented so that when they are supplied lubrication in the form of an oil mist entrained in refrigerant vapor as described above, the oil is pumped through the bearings by the centrifugal forces developed as cone-shaped rollers 25*a* and 26*a* rotate. Supplying oil to the preferred end of the bearings thus helps to insure that they are properly lubricated.

Some of the oil droplets exiting chamber 50 through openings 55 are not drawn through openings 57 and do not provide any lubrication to the main drive shaft bearings 25 and 26. This oil that escapes tends to collect on the outer surface of frame 12 and the inside of shell 11, and drains back into reservoir 43 through a plurality of holes (not shown) formed within annular ring 13. Oil returning to reservoir 43 is available for recirculation by oil pump 44 throughout the compressor 10 to provide lubrication where needed.

The rotors in some commercially available motors do not include tabs 61; however, even a rotor having a smooth end produces a centrifugal fan effect. Even a small differential pressure insures that part of the oil droplets entering chamber 56 settle out on the bottom of the chamber and drain through the conical drive shaft main bearing 25 by gravity flow.

In the preferred embodiment, rotor tabs 61 and swing link 29 provide the differential pressure across the bearings 25 and 26, respectively, through a centrifugal fan effect. Other means for producing this differential pressure may also be used. For example, drive shaft crank 27 may be modified so that it is lobular in shape or so that includes vanes, to create even a greater centrifugal fan effect than provided by swing link 29. Clearly, the lubrication system of this invention may be used to supply oil to other types of drive shaft bearings, such as ball or roller bearings. It will be understood that modifications such as these will be apparent to those skilled in the art within the scope of the invention, as defined in the claims which follow.

We claim:

1. In a scroll apparatus, a system for lubricating a drive shaft main bearng, comprising a. an oil pump connected to the drive shaft and having an inlet submerged in an oil reservoir and an outlet in fluid communication with a spatial volume into which oil circulated by the pump is dispersed generally radially outward from the drive shaft as a mist of oil droplets, said spatial volume being disposed adjacent one end of the drive shaft main bearing and in fluid communication with said one end thereof;

b. a frame supporting the drive shaft main bearing and defining a chamber disposed immediately adjacent the other end of the drive shaft main bearing, said chamber being in fluid communication with the spatial volume; and c. fan means disposed within the chamber, rotatably driven by the drive shaft and operative to draw fluid carrying the oil entrained therein as a mist generally radially inward toward the drive shaft and into the chamber through the drive shaft main bearing, thereby lubricating the bearing.

2. In a scroll apparatus having an orbiting scroll plate and a rotating drive shaft enclosed within a hermetic shell, a system for lubricating a drive shaft main bearing, comprising a. a frame supporting the drive shaft main bearing, said frame defining:

(i) a first chamber immediately adjacent one end of the bearing;

(ii) a second chamber immediately adjacent the other end of the bearing; and (iii) a first and a second opening into said first and second chambers, respectively, providing fluid communication between each chamber and a spatial volume external to the chambers;

b. an oil pump disposed at one end of the drive shaft, extending into an oil reservoir, and operative to pump oil from the reservoir through a bore in the drive shaft to one or more bearings associated with the scroll plate disposed adjacent the other end of the drive shaft, said oil circulating through the one or more bearings, and due to the motion of the drive shaft, being dispersed generally radially outward from the drive shaft into the spatial volume as a mist of oil droplets; and c. fan means, disposed within the second chamber, for impelling fluid out of the second chamber through the second opening, creating a pressure differential between the first and second chambers across the main bearing, and thereby operative to draw fluid carrying the oil mist through the first opening generally radially inward into the first chamber, and through the main bearing to lubricate it.

3. The lubrication system of claim 2 wherein the scroll apparatus further comprises a lobular-shaped radially compliant swing link connecting the drive shaft to the orbiting scroll plate and operative to translate the rotational motion of the drive shaft into the orbital motion of the orbiting scroll plate, said fan means comprising the swing link.

4. The lubrication system of claim 2 wherein the scroll apparatus comprises an electric motor including a rotor, said fan means comprising one end of the rotor.

5. The lubrication system of claim 4 wherein the rotor includes a plurality of projections extending from said one end.

6. In a scroll apparatus having an orbiting scroll plate and rotating drive shaft enclosed within a hermetic shell, a system for lubricating two drive shaft main bearings comprising:

a. a frame supporting the drive shaft main bearings and defining a first chamber and a second chamber at opposite ends of the two main bearings, and a third chamber intermediate the adjacent ends of the two main bearings in fluid communication with an adjoining spatial volume within the hermetic shell; said first and second chambers including first and second openings, respectively, for providing fluid communication between the first and second chambers and the spatial volume;

b. an oil pump disposed at one end of the drive shaft, extending into an oil reservoir, and operative to pump oil from the reservoir through a bore in the drive shaft to a scroll plate thrust bearing and a drive stud bearing disposed adjacent the other end of the drive shaft, said oil circulating through the thrust and stud bearings and at least part of the oil being dispersed generally radially outward from the drive shaft into the spatial volume as a mist of oil droplets due to the motion of the drive shaft; and c. first and second fan means, disposed within the first and second chambers, respectively, for forcing fluid out of said chambers through the first and second openings, creating a pressure differential across the two main bearings and thereby operative to draw fluid carrying the oil mist generally radially inward into the third chamber, and through the two main bearings to lubricate them.

7. The lubricating system of claim 6 wherein the scroll apparatus further includes an electric motor having a rotor connected to the drive shaft, and wherein the first fan means comprises one end of the rotor adjacent the first chamber.

8. The lubricating system of claim 7 wherein the rotor includes a plurality of projections extending from said one end of the rotor.

9. The lubricating system of claim 6 wherein the scroll apparatus further includes a lobular-shaped radially compliant swing link operative to rotate about the longitudinal axis of the drive shaft when driven thereby and to translate the rotational motion of the drive shaft to the orbital motion of the orbiting scroll plate, said second fan means comprising the swing link.

10. The lubricating system of claim 6 wherein the two main bearings are cone bearings including tapered rollers oriented so that the larger diameter ends of the tapered rollers are adjacent the first and second chambers and are radially displaced from the drive shaft relative to the smaller diameter ends of the tapered rollers adjacent the third chamber, the orientation of the main bearings thus encouraging oil flow through the bearings in a direction having a radial component away from the third chamber toward the first and second chambers, respectively.

11. The lubricating system of claim 5 wherein part of the oil passing through the two main bearings is entrained as a mist of droplets in the fluid exiting the first and second chambers through the first and second openings, respectively, due to fluid motion induced by the fan means, and is carried into the spatial volume to recycle into the third chamber and through the two main bearings.

12. The lubricating system of claim 11 wherein part of the oil passing through the two main bearings returns to the oil reservoir.

13. The lubricating system of claim 6 wherein the scroll apparatus is a compressor and the fluid conveying the oil is a refrigerant vapor.

* * * * *